United States Patent [19]

Bortles

[11] Patent Number: 5,035,253

[45] Date of Patent: Jul. 30, 1991

[54] TENT CANOPY RAIN AWNING

[76] Inventor: Allan D. Bortles, 1523 Ontario Dr., Janesville, Wis. 53545

[21] Appl. No.: 405,895

[22] Filed: Oct. 30, 1989

[51] Int. Cl.[5] ..... E04H 15/08

[52] U.S. Cl. ..... 135/89; 135/110; 135/117; 160/45

[58] Field of Search ..... 135/117, 120, 89, 110; 160/45, 46, 53, 54, 76; 52/109; 211/193

[56] References Cited

U.S. PATENT DOCUMENTS

| | | | |
|---|---|---|---|
| 1,846,011 | 2/1932 | Adams | 135/117 X |
| 2,151,908 | 3/1939 | Gottlieb | 135/117 X |
| 2,568,048 | 9/1951 | Arnold | 135/89 X |
| 3,182,672 | 5/1965 | Biller, Jr. | 135/117 |
| 3,186,420 | 6/1965 | Magee | 135/89 |
| 3,327,724 | 6/1967 | Nielsen | 135/120 X |
| 3,512,654 | 5/1970 | Olsen et al. | 211/193 |
| 3,612,145 | 10/1971 | Darula | 135/89 X |
| 3,720,438 | 3/1973 | Johnson et al. | 135/89 X |
| 4,070,803 | 1/1978 | Gartung | 211/193 X |
| 4,779,635 | 10/1988 | Lynch | 135/110 X |
| 4,801,119 | 1/1989 | Pelletier | 135/89 X |
| 4,805,863 | 2/1989 | Armstrong et al. | 211/193 X |

FOREIGN PATENT DOCUMENTS

| | | | |
|---|---|---|---|
| 490904 | 1/1977 | Australia | 135/110 |
| 2509153 | 1/1983 | France | 135/89 |
| 659556 | 10/1951 | United Kingdom | 160/45 |

*Primary Examiner*—David A. Scherbel
*Assistant Examiner*—Lan Mai
*Attorney, Agent, or Firm*—Raymond W. Campbell

[57] ABSTRACT

A rain runoff awning for collecting runoff from a tent canopy. Fabric is stretched between and secured to outwardly extending arms which are attached to the canopy frame. The fabric forms a gutter or trough along an edge of the canopy for receiving runoff from the canopy and directing the runoff away from entrance and exit areas of the canopy.

20 Claims, 4 Drawing Sheets

FIG. 7
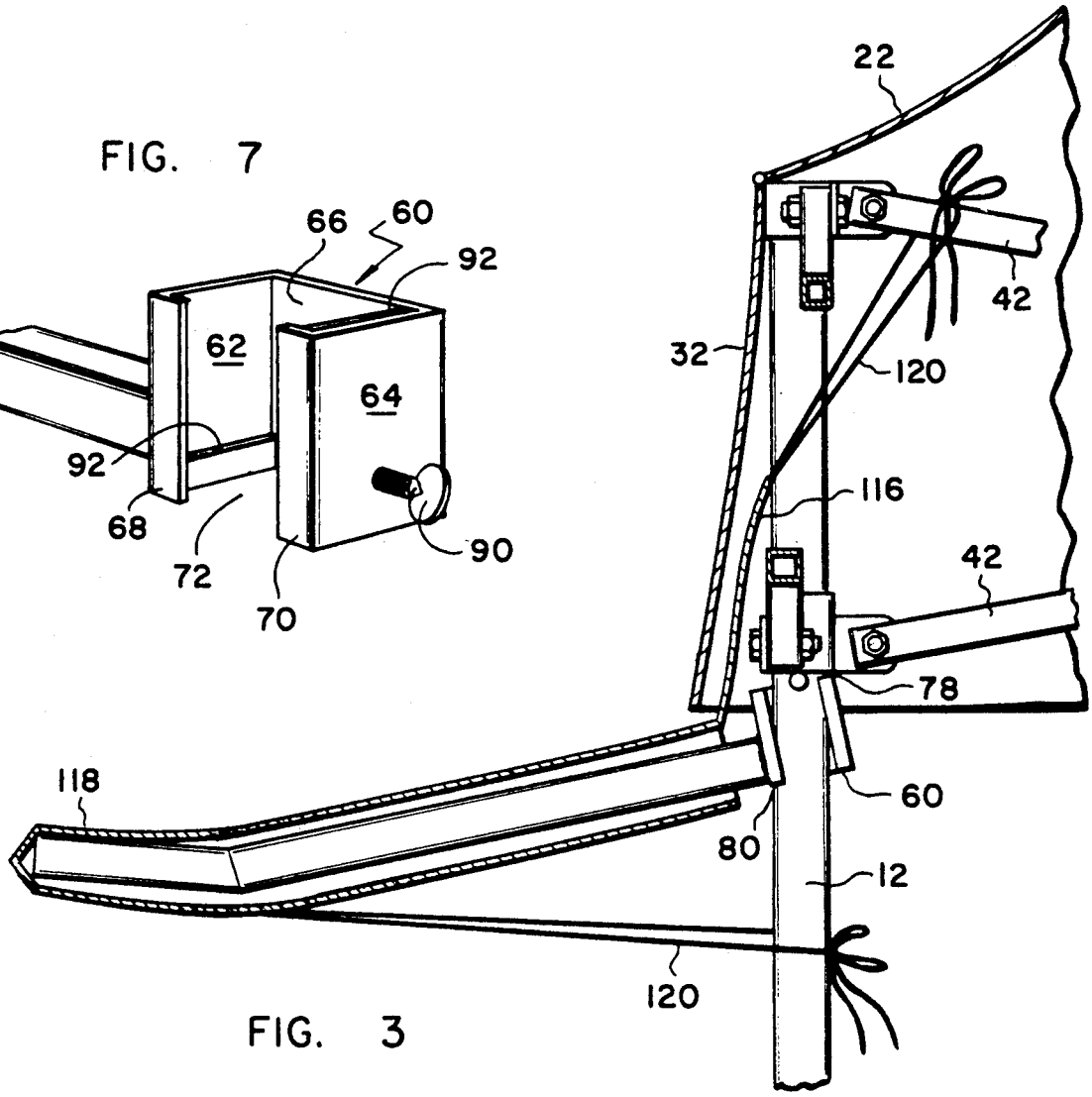
FIG. 3
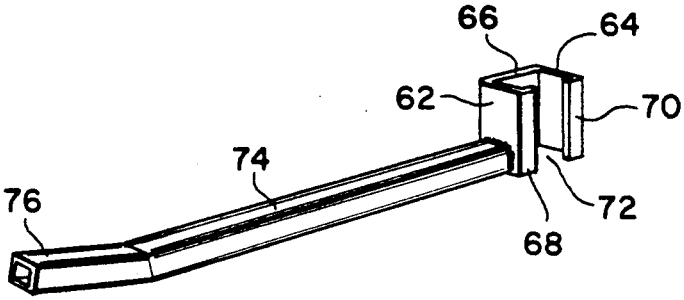
FIG. 4

TENT CANOPY RAIN AWNING

BACKGROUND OF THE INVENTION i. Technical Field

The present invention relates generally to the field of portable, collapsible, tent-like canopies. More specifically, the invention pertains to an accessory for such portable tent-like canopies which can be attached along one or more sides of the canopy to collect rain run-off from the canopy and direct the run-off to a corner or corners of the canopy.

ii. Prior Art

Portable, free-standing, readily collapsible tent canopies are used frequently to provide temporary shelter at fairs, exhibits and social functions. Common structures of this type include a support system of legs and cross-members supporting a fabric roof. The support system is often of angular, cross support "scissor" or "accordion" type, allowing the entire unit to be assembled and disassembled quickly, without attaching and detaching more than a small number of individual members from each other. The collapsed structure is easily transported and stored, requiring minimal space. A typical system of this type is illustrated in U.S. Pat. No. 4,641,676 issued to James P. Lynch on Feb. 10, 1987.

Tent canopies of this type work very well in providing shade and shelter in a temporary situation. A problem is experienced, however, during rainy weather. Typical tent canopies include a roof having a central peak and four sloping surfaces, each defining, generally, a triangle above one of the canopy sides. Rain water collecting on the roof runs down and off each edge of the roof. By necessity, at least one edge of the tent canopy serves as an entrance to the sheltered area beneath the canopy. When the tent canopy is used as a display area at an art or craft fair or other function at which large crowds come and go, visitors passing into and out of the sheltered area beneath the tent canopy can be severely inconvenienced by water running off the canopy.

During a period of hard rain, a dense curtain of water can be created along each edge of the tent canopy. Even during periods of light or intermittent rain, the concentration of runoff along the edges of the canopy creates a considerable water barrier, which may Continue to drip long after the rain has stopped. Those persons passing through this curtain of water can be more inconvenienced than while walking through open areas of rain between adjacent canopies.

Even if the function is temporarily halted during the period of rain, further inconvenience can be experienced upon resumption of the event after the rain has stopped. Particularly when the tent canopy is large, runoff from the roof concentrated along the drip line at the edge of the roof can create a line of mud and sloppy conditions through which the guests must pass when entering and leaving the tent canopy.

SUMMARY OF THE INVENTION

It is therefore one of the primary objects of the present invention to provide a tent canopy rain runoff system for collecting water running off a tent canopy, and for redirecting the collected runoff to deposit the water away from entrances to the sheltered area beneath the canopy.

Another object of the present invention is to provide a simple, yet effective detachable rain awning for collecting rain from a tent canopy to eliminate areas of runoff concentration near entrances to and exits from the tent canopy.

Yet another object of the present invention is to provide a tent canopy rain awning which can be added as a retrofit to most commonly used tent canopies with little or no modification to the tent canopy itself.

A still further object of the present invention is to provide a tent canopy rain awning which can be attached and detached easily and quickly even after the canopy has been erected.

These and other objects are achieved in the present invention by providing outwardly extending awning supports which attach to the outer vertical legs of the tent canopy, normally found at the Corners of the Canopy. The supports include arms extending from attachment fixtures which are secured around the vertical legs of the tent canopy, bearing against the legs along regions on opposite sides of the leg at the top and bottom of the fixture. A horizontal portion of each arm extends outwardly from the fixture. Set screws can be used for physical interference between the vertical support legs and the fixtures, or the areas of contact can be provided with rubber or other material having a high coefficient of friction to reduce tendency of the fixture to slide along the vertical leg.

In addition to the arms attached to the corner vertical support legs, one or more intermediate horizontal arms are provided, attached by hook-like vertical members attached over angular brace members of the canopy support network between the corner vertical legs.

A canvas, nylon or other substantially water-proof material is stretched between the horizontal arms, preferably being provided With pockets for sliding over the horizontal arms. In the preferred structure, the distal end of each horizontal arm is further upwardly inclined to provide a water retaining lip along the outer edge of the awning.

Intermediate horizontal arms are positioned higher than the horizontal arms on the corner vertical support legs of the tent canopy so that water collected will run toward corner posts of the tent canopy.

Further objects and advantages of the present tent canopy rain awning will become apparent from the Detailed Description to follow and the drawings accompanying it.

BRIEF DESCRIPTION OF THE DRAWINGS

FIG. 3 is an enlarged, cross-sectional view of the rain runoff awning of the present invention shown in FIG. 2, taken along line 3—3 of FIG. 2.

FIG. 4 is a perspective view of one of the outer horizontal supports of the rain runoff awning.

FIG. 7 is a fragmentary, perspective view of a modified embodiment of an outer horizontal arm for the present rain runoff awning.

DETAILED DESCRIPTION OF THE PREFERRED EMBODIMENTS

Figure 1:
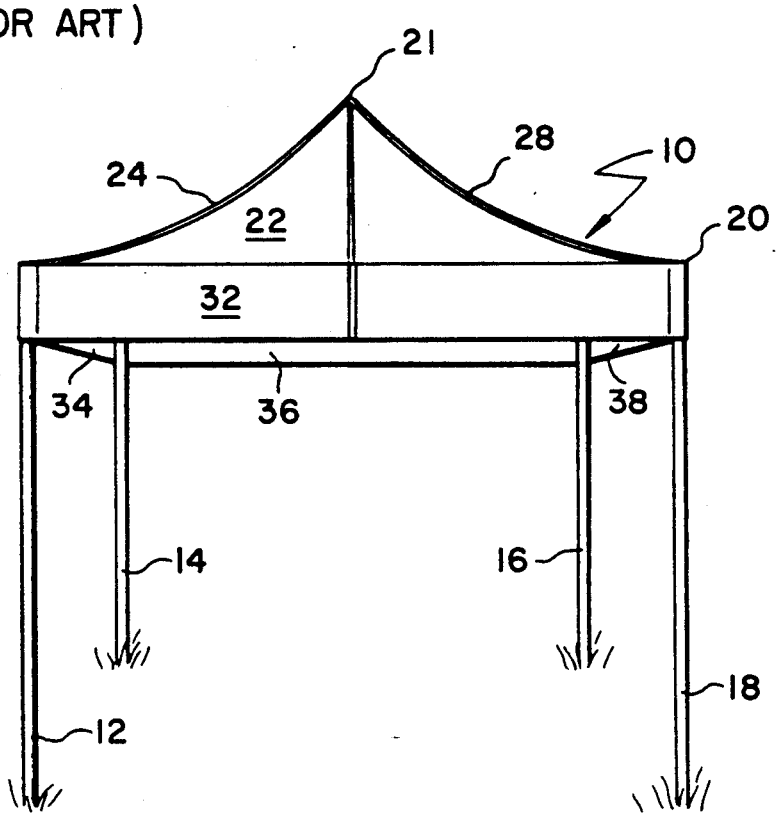
FIG. 1 (PRIOR ART)
FIG. 1 is a perspective view of a common portable, collapsible tent canopy structure on which the present invention can be added as an attachment.

Referring now more specifically to the drawings, and to FIG. 1 in particular, numeral 10 designates a portable tent canopy of the prior art having corner vertical legs 12, 14, 16 and 18 and a fabric roof designated generally by numeral 20. The roof 20 includes a central peak 21 and generally triangular shaped fabric surfaces 22, 24, 26 and 28 sloping downwardly from peak 21. Substantially vertical side surfaces 32, 34, 36 and 38 contiguous with the sloping surfaces extend over a top portion of the legs and downwardly therealong from the roof surfaces 22, 24, 26 and 28. A roof support network 40 of interconnected, angular brace members 42 attached to each other in scissor-like fashion is disposed between and attached to the legs 12, 14, 16 and 18. This accordion style system, allows the canopy to be folded and expanded with minimal effort, usually requiring only one person.

Figure 2:
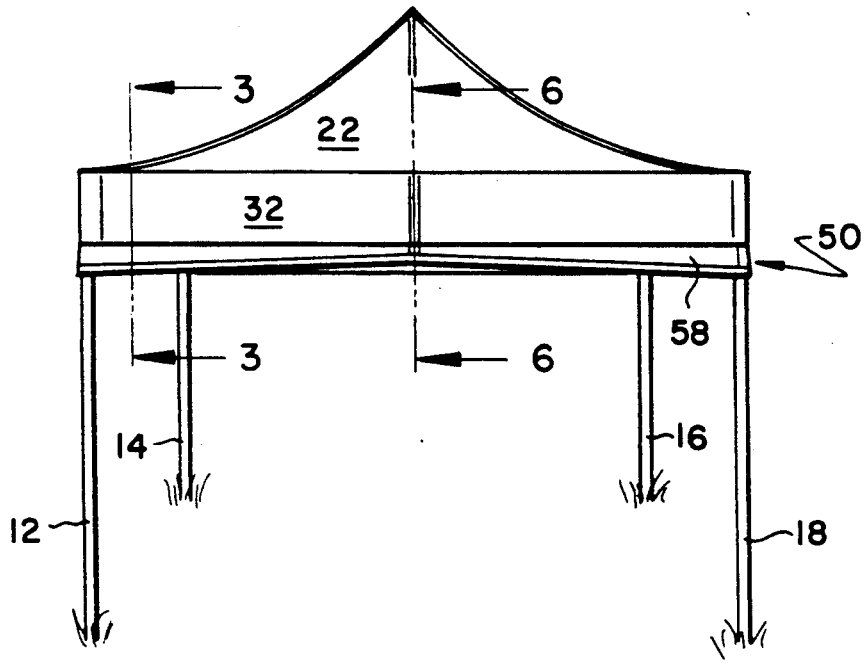
FIG. 2 is a perspective view similar to that shown in FIG. 1, but additionally showing a rain runoff awning according to present invention attached along one edge of the canopy.

In FIG. 2, a rain runoff awning 50 of the present invention is shown attached to the tent canopy 10, for collecting rain running off sloping surface 22 and side surface 32 and for directing the collected rain toward the legs 12 and 18. The awning 50 can be used on most types of commonly available tent canopies, to eliminate the aforementioned problems associated with rain runoff. For some canopy uses, it may be advantageous to use 2, 3 or even 4 awnings 50. For purposes of illustration, only one is shown in the drawings.

The awning 50 includes end horizontal supports 52 and 54 attached to the legs 12 and 18, and one or more intermediate horizontal support 56 attached to a brace member or members 42 of the roof support network 40. A sheet 58 of waterproof material such as canvas or nylon is stretched over the supports 52, 54 and 56.

Referring now to FIG. 3, end support 52 is shown enlarged and in greater detail. Support 52 includes an attachment fixture 60 which partially surrounds leg 12. Fixture 60 includes a front wall 62, a back wall 64 and a full outer side wall 66. Opposite the side wall 66, partial inner side walls 68 and 70 are attached to the front wall 62 and back wall 64, respectively. partial side walls 68 and 70 define between them an opening 72. Support 52 is attached to leg 12 by aligning opening 72 with a section of the leg 12 and passing the leg through the opening 72.

Support 52 further includes an arm 74 extending outwardly from the front wall 62, with an inclined distal end portion 76. When support 52 is properly installed on the leg 12, the arm 74 is slightly downwardly disposed, and the distal end portion 76 is inclined upwardly from the arm 74 and, preferably, slightly upwardly from horizontal.

Natural positioning of the support on the leg, when properly sized and installed, results in the upper edge 78 of back wall 64 and the lower edge 80 of front wall 62 engaging against the leg as shown most clearly in FIG. 3.

As weight is applied against the support, such as when the runoff awning collects rain, greater force is applied by the edges 78 and 80 against the leg 12, further stabilizing the position of the support on the leg. On particularly long or large awnings, it may be desirable to use a set screw 90 through the attachment fixture 60 against the leg 12. As shown in FIG. 7, the set screw 90 extends through the lower portion of back wall 64 or, alternatively, may extend through the upper portion of front wall 62. By tightening the set screw 90 against the leg 12, movement of the attachment fixture 60 relative to the leg 12 is further limited. As yet another alternative, a strip 92 of natural or synthetic rubber or other material having a high coefficient of friction can be attached along the upper edge 78 and/or lower edge 80 for stability.

End support 54 is similar to the aforedescribed end support 52, except that the attachment fixture is oppositely directed so that the opening 72 of support 54 is also located on the inside of the support. By providing the openings on the inside of the fixtures of both end support 52 and end support 54, greater stability is provided to the awning when the sheet 58 is installed. In the drawings, the same numerals have been used to identify parts of support 54 similar to the correspondingly numbered parts of support 52.

Figure 5:
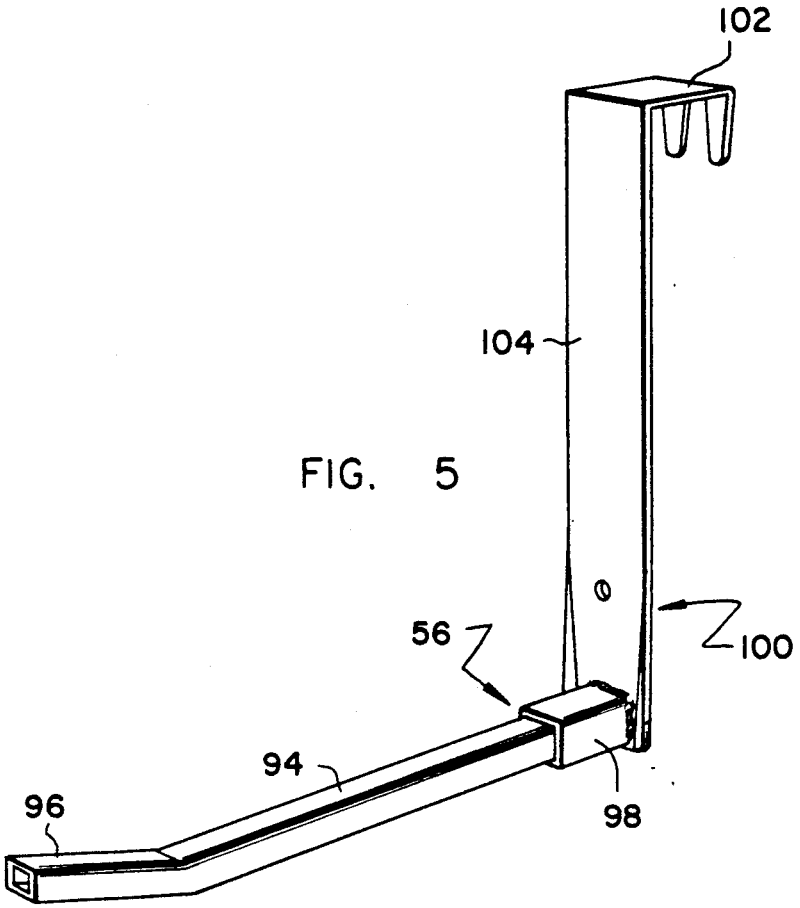
FIG. 5 is a perspective view of an intermediate horizontal support of the rain runoff awning.
Figure 6:
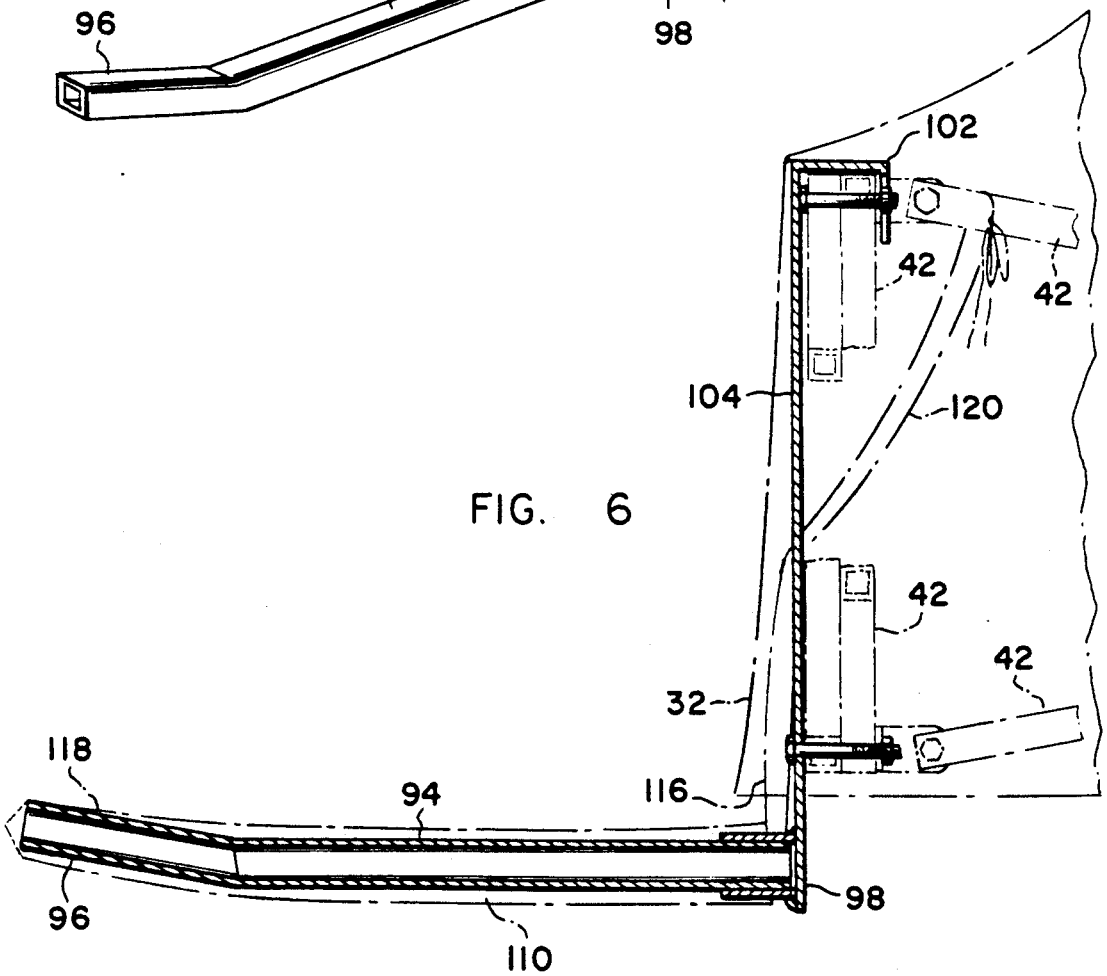
FIG. 6 is an enlarged, cross-sectional view of the rain runoff awning shown in FIG. 2, taken along line 6—6 of FIG. 2.
Figure 8:
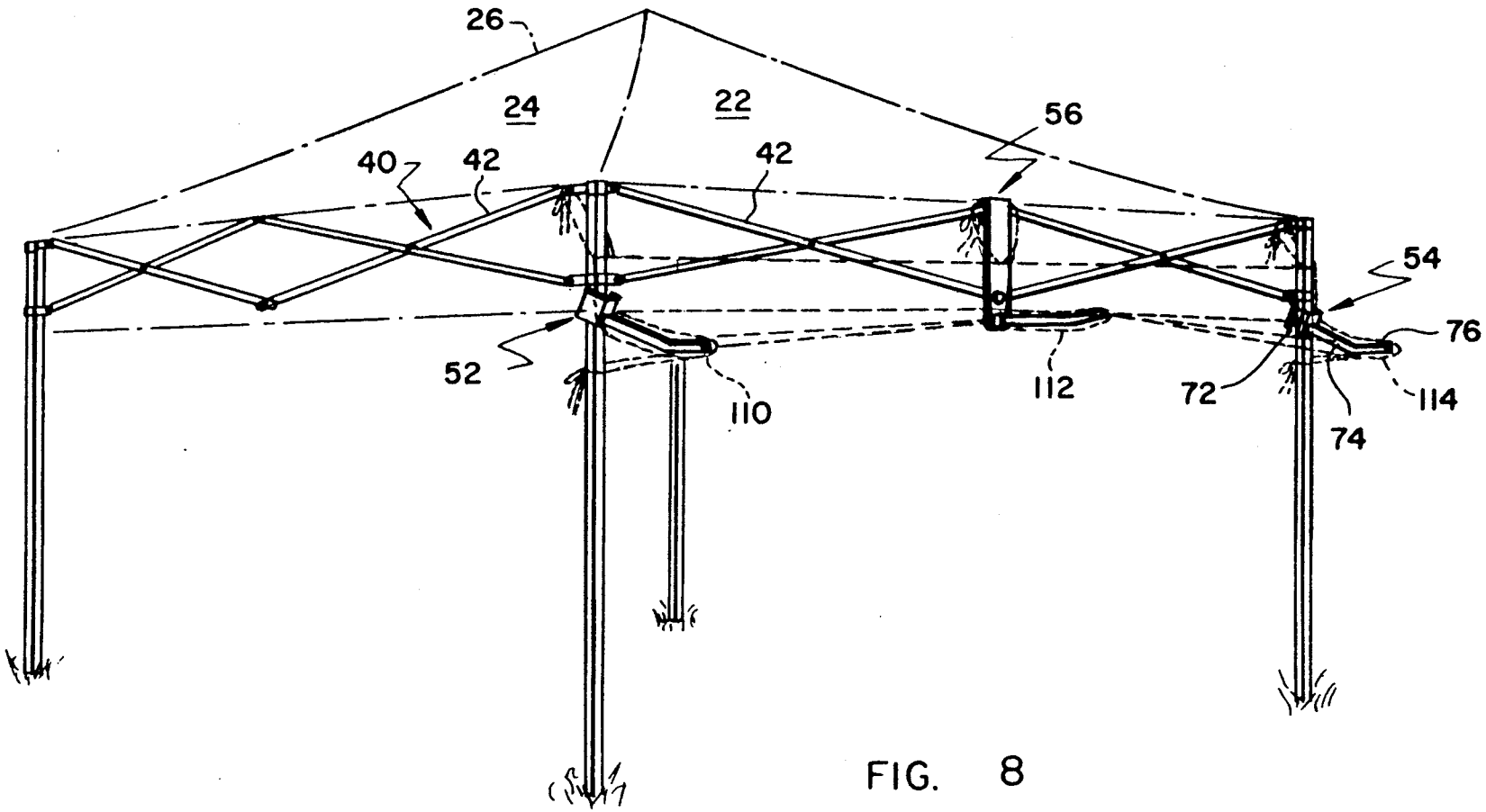
FIG. 8 a perspective view of the tent canopy with a rain runoff awning, with fabric portions shown by broken lines to reveal, particularly, the installed positions of the horizontal supports.

Intermediate support 56 will be described more specifically with reference to FIGS. 5 and 6. While normally the outer supports 52 and 54 are a single piece, intermediate arm 56 is advantageously supplied in two pieces. Such two piece construction aids and simplifies attachment to and detachment from the canopy and storage of the awning.

Support 56 includes an arm 94 with an upwardly inclined distal end portion 96 similar to the arm 74 and distal end portion 76 of the end supports 52 and 54. The end of arm 94 opposite the distal end portion 96 is held in a receptacle 98 of a suspension member 100. Receptacle 98 is closely fitted to the arm 94 so that the arm is retained in the receptacle by interference. Alternatively, a set screw or other positive locking device can be used to retain the arm in the receptacle. The suspension member 100 includes a hook 102 for engaging a brace 42 of the network 40 and a suspension segment 104 between the hook 102 and the receptacle 98. Both or either the suspension segment 100 or the hook 102 may include breaks or slight bends or creases to increase their rigidity.

Sheet 58 extends between and over the end supports 52 and 54 and the intermediate support 56. Pockets 110, 112 and 114 on the bottom of sheet 58 receive the distal end portions 76 and 96 and the arms 74 and 94 of the supports 52, 54 and 56. Preferably, the sheet 58 is of sufficient width to extend entirely over the supports 52, 54 and 56, with sufficient excess width to allow an inner portion 116 of the sheet 58 to extend upwardly beneath at least a portion of the vertical side surface 32 throughout its full length. The outer portion of the sheet forms a lip 118, stretched between the distal ends of support arms.

To secure the fabric in place on the arms, a plurality of ties 120 are provided of sufficient length to reach the support network 40. The ties are attached upwardly of the arms 74 and 94 on the inside of the canopy. In this way the inner edge of the fabric sheet 58 is secured behind the side surface 32, to Collect all the water running off the surfaces 22 and 32. When the spacing between adjacent arms is considerable, intermediate ties 120 can be provided between the arms. When the ties are secured the sheet 58 can not slide off the arms 74 and 94.

In the installation and use of a tent canopy rain awning according to the present invention, the tent canopy can be substantially erected before the awning is attached. If inclement weather is not expected, the awning need not be attached. Even if rain arises suddenly and unexpectedly, the awning can be attached quickly and easily without significant disassembly of the canopy.

To attach the awning, canopy side surface 32 is raised to expose the upper portions of the legs 12 and 18 and a portion of the roof support network 40. Hook 102 of intermediate support 56 is secured over an upper brace member 42, with the suspension segment 104 and receptacle 98 depending downwardly therefrom. Arm 94 is inserted and secured in the receptacle 98. Normally, lower portions of segment 104 rest against a lower brace member 42, and the arm 94 is substantially horizontal in orientation.

End supports 52 and 54 are attached to legs 12 and 18 by aligning the openings 72 with a portion of the extent of the leg and passing the attachment fixture around the leg. Alternatively, in some designs and for some canopies, the fixture Can be slid downwardly over the top of the leg, in which case the opening 72 is not required.

Vertical positioning of the end supports 52 and 54 is achieved by aligning the attachment fixture 60 with the leg and sliding the support upwardly or downwardly. Normally the side supports are positioning slightly lower than the arm 94 of intermediate support 56, thereby causing water collected on the awning to run from the center of the awning length toward the awning ends at the legs 12 and 18. If the canopy is not very large and the awning not very long, it may be possible to omit the intermediate support. In this situation, it is preferable that one end support be higher than the other.

The sheet of material is attached to the supports by sliding each of the pockets 110, 112 and 114 over an arm of supports 52, 54 and 56. The inner portion 116 is brought inwardly and upwardly behind side surface 32, and ties 120 are secured to the legs, brace members or the Like.

As water collects and runs downwardly over and off the surface 22 it is collected in the rain awning 50 and is conducted thereby toward the legs 12 and 18. People entering or leaving the protected area beneath the canopy do not have to pass through a concentrated barrier of water running off the roof, and they will encounter only the normal rainfall as they pass under the awning. Concentrated water flows are directed toward the legs 12 and 18, minimizing a mud line underneath the canopy edge.

While an embodiment and several modifications for a tent canopy rain awning have been shown and described in detail herein, various other changes may be made without departing from the scope of the present invention.

I claim:

1. A detachable tent canopy rain awning for a portable tent canopy having a roof supported by a brace network and vertical legs, said awning comprising:

a plurality of support members, each support member including, means for attaching the member to a vertical leg of the brace network of the canopy, and an arm extending from said means for attaching the member outwardly beyond an outer edge of the canopy roof; and a sheet of material adapted for engaging said support members, to be held by said arms and positioned by said arms for receiving and collecting runoff from the edge of the canopy roof and conducting the runoff toward an end of the sheet of material, said sheet of material being disposed over and between said arms to define a generally horizontally disposed surface for collecting runoff from the roof, said sheet of material and said arms further defining a water retaining lip restricting runoff collected on said generally horizontally disposed surface from cascading off said awning along the edge between said vertical legs and directing the collected runoff toward an end of the awning near a vertical leg.

2. A tent canopy rain awning as defined in claim 1 in which a support member is provided at each of two legs of the canopy and said sheet of material extends substantially along an entire side of the tent canopy.

3. A tent canopy rain awning as defined in claim 2 in which an intermediate support member is disposed between said two legs, along the outer edge of the canopy and is attached to braced of the tent canopy brace network.

4. A tent canopy rain awning as defined in claim 3 in which the arm of said intermediate support member is higher than the arms of said support members provided at said two legs.

5. A tent canopy rain awning as defined in claim 3 in which each arm of said plurality of support members includes an inclined distal end portion.

6. A tent canopy rain awning as defined in claim 3 in which said intermediate support member includes a hook for engaging a brace member, a depending segment having a receptacle thereon and the arm of said intermediate support member is received by and removable from said receptacle.

7. A tent canopy rain awning as defined in claim 3 in which said sheet of material includes pockets for receiving the arms of said support members.

8. A tent canopy rain awning as defined in claim 3 in which an inner portion of said sheet of material extends behind and is overlapped by the roof of the canopy.

9. A tent canopy rain awning as defined in claim 3 in which a plurality of strings are attached to the sheet of material for tieing the sheet of material to legs or braces of the canopy.

10. A tent canopy rain awning as defined in claim 3 in which said support members at said legs include attachment fixtures at least partially surrounding said legs.

11. A tent canopy rain awning as defined in claim 1 in which each arm of said plurality of support members includes an inclined distal end portion.

12. A tent canopy rain awning as defined in claim 11 in which said sheet of material includes pockets for receiving the arms of said support members.

13. A tent canopy rain awning as defined in claim 12 in which an inner portion of said sheet of material extends behind and is overlapped by the roof of the canopy.

14. A tent canopy rain awning as defined in claim 1 in which said sheet of material includes pockets for receiving the arms of said support members.

15. A tent canopy rain awning as defined in claim 1 in which an inner portion of said sheet of material extends behind and is overlapped by the roof of the canopy.

16. A tent canopy rain awning as defined in claim 1 in which a plurality of strings are attached to the sheet of material for tieing the sheet of material to legs or braces of the canopy.

17. A rain awning attachment for a tent canopy, for collecting runoff from the canopy and directing it toward legs of the canopy, said awning comprising;

outer support members having attachment fixtures for engaging legs of the canopy, an intermediate support member including a hook for engagement over brace members of the canopy between the legs engaged by said outer support members, arms extending outwardly from each of said support member, fabric secured to and stretched between said arms, said fabric forming a trough for receiving runoff from the canopy, and said trough including a generally horizontal portion for receiving runoff from the canopy and an outer edge lip for restricting flow over the edge between adjacent arms.

18. A rain awning as defined in claim 17 in which each of said arms includes an included distal end portion.

19. A rain awning as defined in claim 17 in which pockets are provided on said fabric for receiving said arms.

20. A rain awning as defined in claim 17 in which said fabric extends inwardly behind the canopy.

* * * * *